US012742270B2

(12) United States Patent
Comotto et al.

(10) Patent No.: US 12,742,270 B2
(45) Date of Patent: Sep. 22, 2026

(54) WEFT FEEDER FOR WEAVING LOOMS, INCLUDING AN INDEPENDENT OPTICAL UNIT INTEGRATED INTO THE ELECTROMAGNET GROUP CONTROLLING THE WEFT THREAD RELEASE

(71) Applicant: ROJ S.R.L., Biella (IT)

(72) Inventors: Riccardo Comotto, Biella (IT); Claudio Mariuzzo, Biella (IT)

(73) Assignee: ROJ S.R.L., Biella (IT)

( * ) Notice: Subject to any disclaimer, the term of this patent is extended or adjusted under 35 U.S.C. 154(b) by 0 days.

(21) Appl. No.: 19/063,541

(22) Filed: Feb. 26, 2025

(65) Prior Publication Data

US 2025/0277328 A1 Sep. 4, 2025

(30) Foreign Application Priority Data

Feb. 29, 2024 (IT) ..... 102024000004420

(51) Int. Cl.
*D03D 47/36* (2006.01)
*D03D 45/12* (2006.01)

(52) U.S. Cl.
CPC ..... *D03D 47/367* (2013.01); *D03D 45/12* (2013.01)

(58) Field of Classification Search
None
See application file for complete search history.

(56) References Cited

U.S. PATENT DOCUMENTS 4,276,910 A * 7/1981 Eichenberger ..... D03D 45/12 139/273 A
4,901,771 A * 2/1990 Maina ..... B21C 23/142 139/452

(Continued)

FOREIGN PATENT DOCUMENTS

DE 10159227 A1 6/2003
EP 3620561 A1 3/2020

(Continued)

OTHER PUBLICATIONS

"Box." Word Hippo. Aug. 30, 2025. https://www.wordhippo.com/what-is/the-meaning-of-the-word/box.html (Year: 2025).*

(Continued)

*Primary Examiner* — Grace Huang
(74) *Attorney, Agent, or Firm* — Chrisman Gallo Tochtrop LLC

(57) ABSTRACT

Weft feeder for weaving looms including a winding group to wind a weft thread on a weft feeder drum, an optical unit provided with one or more optical sensors to monitor the weft thread winding on the drum and its release from said drum, an electromagnet group to control the movement of a stop pin which prevents the weft thread from being released from said drum, wherein said electromagnet group is enclosed within a cup-shaped shell from which said stop pin protrudes to interfere with said drum, and a weft feeder processing board which controls the logical functions of the weft feeder. The optical group is contained in a protection box and it is electrically connected to said weft feeder processing board by direct wiring, and said protection box is housed and removably fixed inside said cup-shaped shell.

11 Claims, 5 Drawing Sheets

(56) References Cited

U.S. PATENT DOCUMENTS

| | | | | | |
|---|---|---|---|---|---|
| 5,046,537 | A * | 9/1991 | Maina | D03D 47/362 | 242/365.5 |
| 5,123,455 | A * | 6/1992 | Maina | B65H 51/16 | 139/452 |
| 5,283,623 | A * | 2/1994 | Muhlberg | G01N 21/8983 | 250/559.47 |
| 5,509,281 | A * | 4/1996 | Tsay | D04B 35/32 | 15/301 |
| 5,613,528 | A * | 3/1997 | Zenoni | D03D 47/367 | 139/452 |
| 5,966,211 | A * | 10/1999 | Lilja | D03D 47/367 | 356/429 |
| 6,062,501 | A * | 5/2000 | Halvarsson | H03K 17/97 | 242/365.3 |
| 6,095,200 | A * | 8/2000 | Hellstroem | D03D 47/367 | 356/429 |
| 6,279,619 | B1 * | 8/2001 | Halvarsson | D03D 47/361 | 139/452 |
| 6,409,114 | B1 * | 6/2002 | Magnusson | D03D 47/367 | 242/364.7 |
| 6,513,554 | B1 * | 2/2003 | Hellstrom | D04B 35/14 | 340/3.5 |
| 7,094,463 | B2 * | 8/2006 | Haas | B29C 44/352 | 521/142 |
| 9,050,937 | B2 * | 6/2015 | Gong | B60R 13/10 | |
| 9,394,635 | B2 | 7/2016 | Ballabio | | |
| 9,629,220 | B2 * | 4/2017 | Panopoulos | H05B 47/19 | |
| 9,976,735 | B2 * | 5/2018 | Honda | F21K 9/27 | |
| 10,082,227 | B2 * | 9/2018 | Hoffman | H02G 3/04 | |
| 11,208,759 | B2 * | 12/2021 | Comotto | G01D 5/30 | |
| 11,326,769 | B2 * | 5/2022 | Majerczyk | F21V 17/12 | |
| 2009/0279313 | A1 * | 11/2009 | Teragawa | G02B 5/0247 | 428/188 |

FOREIGN PATENT DOCUMENTS

| | | | | |
|---|---|---|---|---|
| WO | WO-2004094285 | A1 * | 11/2004 | D03D 47/367 |
| WO | 2005100658 | A1 | 10/2005 | |
| WO | WO-2005102892 | A1 * | 11/2005 | D03D 47/367 |
| WO | WO-2006002893 | A1 * | 1/2006 | D03D 47/367 |
| WO | WO-2008055571 | A1 * | 5/2008 | D03D 47/367 |

OTHER PUBLICATIONS

"Half." Merriam Webster. Aug. 30, 2025. https://www.merriam-webster.com/dictionary/half (Year: 2025).*

Dunn, Tara. "Rigid-Flex PCBs: Advantages and Challenges". Altium. Oct. 2, 2023. https://resources.altium.com/p/rigid-flex-pcbs-advantages-and-challenges (Year: 2023).*

Bahl, Amit. "7 Must-Knows for Your Flex PCB Design." Sierra Circuits. Jan. 25, 2023. https://www.protoexpress.com/blog/5-must-knows-for-your-first-flex-design/ (Year: 2023).*

* cited by examiner

WEFT FEEDER FOR WEAVING LOOMS, INCLUDING AN INDEPENDENT OPTICAL UNIT INTEGRATED INTO THE ELECTROMAGNET GROUP CONTROLLING THE WEFT THREAD RELEASE

CROSS-REFERENCE TO RELATED APPLICATIONS

This application claims the benefit of Italian Patent Application No. 102024000004420 filed on 29$^{th}$ Feb. 2024, the entire disclosure of which is hereby incorporated herein by reference.

FIELD OF THE INVENTION

The present invention relates to a new weft feeder for weaving looms—and particularly for air jets looms and water jet looms-which is provided, in addition to the normal functions already offered by the currently available weft feeders of the known type, with an independent optical unit integrated into the weft feeder electromagnet group controlling the weft thread release.

PRIOR STATE OF THE ART

As is well known, weft feeders are weft thread feeding devices, interposed between the loom and the yarn spools, which feeds the loom with the weft thread by continuously accumulating it in successive coils on a cylindrical drum at as constant a speed as possible—in the clockwise or counterclockwise direction depending on the thread features—so as to create a reserve of weft thread which is subsequently extracted from the weft feeder drum in the axial direction at a variable speed—during the insertion operation of the weft thread in the shed—without thus causing tension peaks in the weft thread, which would undermine both the integrity of the thread itself and the quality of the fabric.

Weft feeders are devices which have been in current use for many years in the weaving mills. Along their evolution over the years, in addition to the basic functions mentioned above, they have been enhanced with additional control functions which allow to verify the weft thread constant presence at certain critical points of the weft feeder, to adjust the amount of weft thread accumulated in the reserve and possibly the distance between the individual coils, to slow down the outgoing weft thread in order to contain the dynamic effects caused by the sudden drawing acceleration, to measure the length of the weft thread section drawn by the insertion devices, and finally to control the weft thread release in a predetermined length for insertion in the shed of the warp threads.

To be able to correctly carry out the above functions, the weft feeder (FIG. 1) is equipped with an optical unit P and an electromagnet group E (hereinafter also referred to as "ELM group"), both mounted on the weft feeder base body C. The optical unit P includes one or more optical sensors and performs the function of monitoring the weft thread winding on the drum D by the winding group W which is integral with the hollow shaft A of the weft feeder, through a feedback control of the weft feeder electric engine which controls the hollow shaft A rotation. The optical unit P controls therefore the deposition of new coils of weft thread on the drum D and also has the function of counting the number of coils released from drum D to the weft insertion devices. The electromagnet group E controls the rectilinear movement of a stop pin 15 between an advanced position, wherein the free end of said stop pin is inserted into a corresponding seat provided in the weft feeder drum D, thus preventing the weft thread from being released from said drum, and a retracted position which allows instead the desired number of coils of weft thread to be released. Thanks to the action of the electromagnet group E the weft thread may in fact be drawn from the loom in a predefined number of coils, which number is indeed counted by said optical unit P.

A single optical unit includes several optical sensors having different functions, namely:

- an entry optical sensor T, which verifies the regular entry of the weft thread onto the drum at each turn of the weft feeder winding group W and which identifies any breaks in the weft thread;
- two exit optical sensors S and Z, respectively for the two directions of rotation according to which the weft thread can be wound onto the drum D by the winding group W, which detect the weft thread exiting the drum and count the number of coils drawn from the loom, to which corresponds a certain length of drawn weft thread;
- a reserve verification optical sensor R, which detects the presence of coils at a pre-set height of the drum, thus allowing the maximum number of coils accumulated on the drum to be maintained constant.

The number of optical sensors mounted on each optical unit varies according to the type of functions performed and therefore to the cost of the weft feeder, ranging from the basic optical unit having a minimum configuration suitable for the simplest operation, which uses only two sensors—namely the entry and exit sensors T and S—to the optical unit having the most advanced technology, which mounts all the four types of optical sensors described above, i.e., also a second exit sensor Z and the reserve verification optical sensor R in addition to the sensors T and S.

For convenience and ease of assembly and connections, the optical unit P is usually assembled jointly with the electromagnet group E. However, this joint assembly of the optical unit and ELM group has followed so far two substantially different embodiments. In a first embodiment, in fact, the optical unit P is autonomous and mounted externally to the electromagnet group E, while in a second embodiment the optical unit P is mounted inside the electromagnet group E, i.e., enclosed within the same metal cup-shaped shell 11 where the ELM group is housed, and it is mechanically and electrically connected to the ELM group.

In the first embodiment, the electromagnet group E is provided with suitable seats for the assembly and passage of the cables of the various optical sensors, located in suitable areas of the external surface of the cup-shaped shell 11 of the ELM group, in view of the specific verification function typical of each one of said optical sensors; in this first solution, the optical sensors are normally made of traditional electronic components (so-called "through-hole", manually soldered and then sealed in a block of resin). The advantageous aspects of this first embodiment essentially comprises the fact that the optical units are completely independent from the ELM group and therefore related maintenance, testing and replacement are simple, quick and economical operations; furthermore, during production, said optical units can be individually and separately tested before assembly on the ELM group. However, in the face of such advantages, the first embodiment described above entails several drawbacks due to the fact that the used components are bulky and therefore require plenty of space for their installation and related wiring; it is therefore very difficult to equip a weft feeder with all the four types of optical sensors described above, and thus this technical solution is often limited to the weft feeders having only the basic optical sensors T and S. Furthermore, the installation of said optical units on the external surface of the cup-shaped shell 11 enclosing the ELM group entails textile disadvantages because the evenness of the external surface of the ELM group cup-shaped shell is impaired by said optical units, thus significantly increasing the possibility that the weft thread becomes entangled in the same during the release step of the weft thread from the weft feeder.

In the second embodiment, the optical unit P is instead made up of miniaturized electronic components, suitable for automatic surface mounting technology (SMT) on a printed circuit board (PCB). Said printed circuit board, to which appropriate diaphragms and optical screens are then added, is fixed, resinated, and sealed inside the cup-shaped shell 11 of the ELM group. The advantageous aspects of this second solution are first of all connected to the fact that all the components of the optical unit P and the electromagnet group E are enclosed inside the same cup-shaped shell 11, the external surface of which can therefore be cleaner and more even and thus improve the operation of the weft feeder from a textile point of view. Furthermore, the use of miniaturized components on PCB and the insertion of the PCB inside the cup-shaped shell 11 makes it much easier to implement all four types of optical sensors described above—and therefore not only the optical sensors T and S, but also the optical sensors R and Z—without significant increase in costs, by means of appropriate windows formed in suitable positions of said cup-shaped shell 11. The only drawback of this second solution, which is completely specular to the only advantage of the first solution, is that the optical unit P is permanently incorporated in the cup-shaped shell and interconnected to the other components of the ELM group, so that in the production the various components cannot be tested separately and, during use, a failure of any one of the optical sensors requires the replacement of the entire package including the optical unit P, the electromagnet group E and the related protective metal cup-shaped shell 11, thus significantly affecting the maintenance or replacement costs. EP-3620561, in the name of the same Applicant, discloses a weft feeder comprising an optical unit manufactured in accordance with the second embodiment described above.

The technical problem addressed by the present invention is therefore that of producing a weft feeder comprising an optical unit which offers all the advantages of both the two currently known and above-described embodiments of an optical unit, without suffering the related drawbacks. An optical unit which is therefore arranged inside the same cup-shaped shell wherein the electromagnet group is housed, and which is nevertheless suitable for being independently tested during manufacturing and which can be maintained and possibly replaced without necessarily involving the electromagnet group in this operation.

In the context of this technical problem, a first object of the invention is to provide a completely autonomous optical unit which can be housed, in an independent and easily removable manner, in the same cup-shaped housing shell as the electromagnet group.

A second object of the invention is to reduce the number of wirings coming out of the optical unit to a single wiring, instead of the two or more wirings of the traditional method.

Finally, a third object of the invention is to manufacture an optical unit which can optionally include in a single design only some or all the four different types of optical sensor, without having therefore to modify its construction, to speed up the operations of manufacturing, testing, maintaining and replacing the optical unit.

SUMMARY OF THE INVENTION

This problem is solved, and these objects achieved, by means of a weft feeder for weaving looms provided with an independent optical unit integrated into the weft feeder electromagnet group which controls the release of the weft thread, having the features defined in the independent claim 1. Other preferred features of such a weft feeder are defined in the secondary claims.

BRIEF DESCRIPTION OF THE DRAWINGS

Further features and advantages of the weft feeder provided with an independent optical unit integrated into the electromagnet group which controls the release of the weft thread according to the present invention will however become more evident from the following detailed description of a preferred embodiment of the same, given by mere way of non-limiting example and illustrated in the accompanying drawings, wherein.

DETAILED DESCRIPTION OF THE PREFERRED EMBODIMENT

According to the present invention, in order to solve the above-mentioned problem by means of a constructively innovative solution which is quick and easy to be assembled, tested, maintained and replaced, the independent optical unit P consists of a rigid-flex printed circuit board housed inside a closed and sealed protection box, from which only a wiring comes out for connection to a main weft feeder processing board controlling the logical functions of the weft feeder. Said protection box has dimensions and shape which allow it to be stably housed and fixed, by means of removable fixing means, onto the bottom wall of the cup-shaped shell enclosing the electromagnet group E. In said protection box, all the other accessory elements necessary for a correct operation of the optical sensors detecting the weft thread are also pre-printed or inserted, so that the optical unit P according to the invention is a completely autonomous group which has no permanent connection, whether mechanical or electrical, with the ELM group and the relative cup-shaped shell 11 enclosing it, so that it can be quickly and easily removed from the same, for replacement or maintenance operations, by simply loosening the aforementioned removable fixing means, after having disconnected the end plug of the wiring from the weft feeder processing board and freed the wiring from any existing cable glands.

Figure 1:
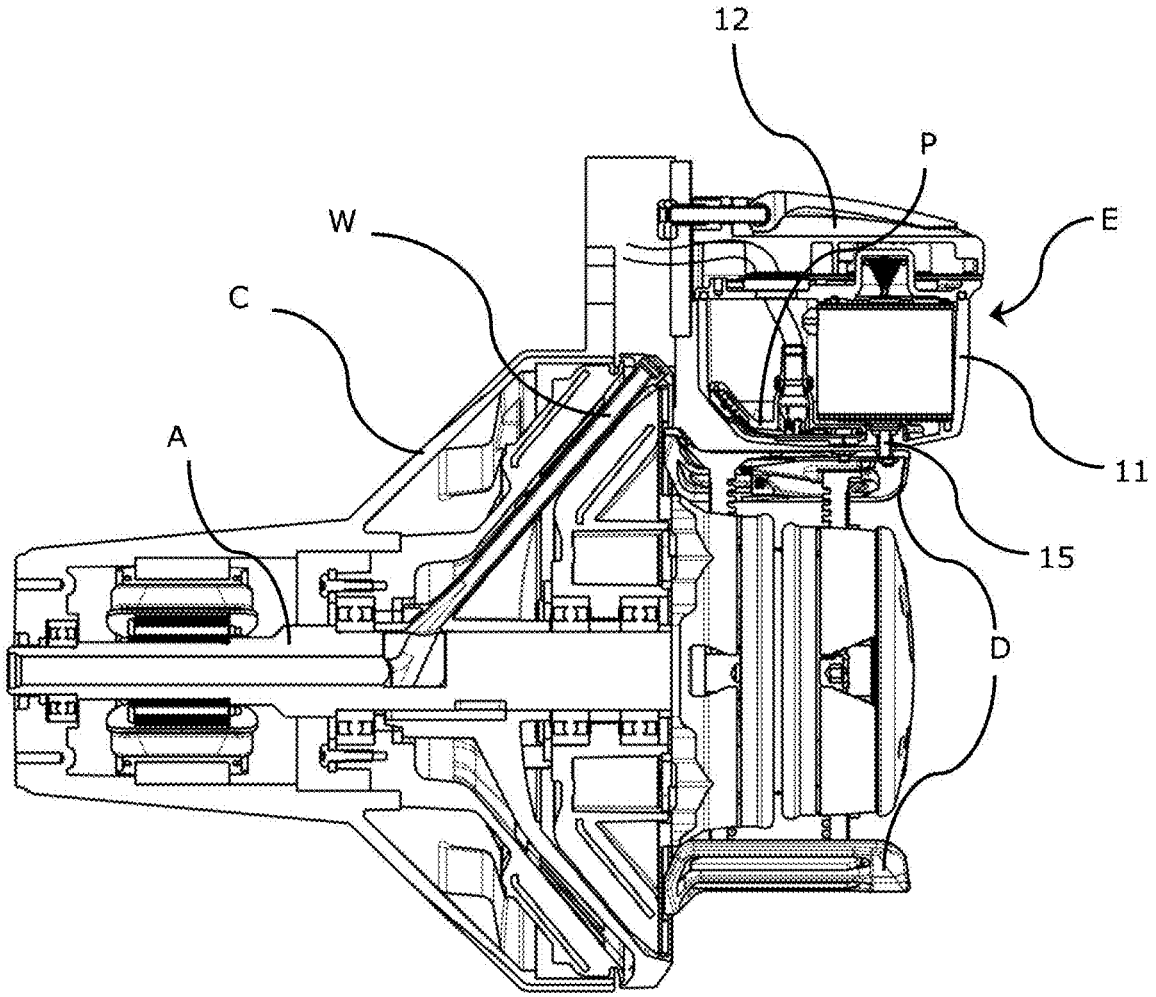
FIG. 1 is an axial sectional view of a weft feeder provided with the independent optical unit of the present invention.
Figure 2:
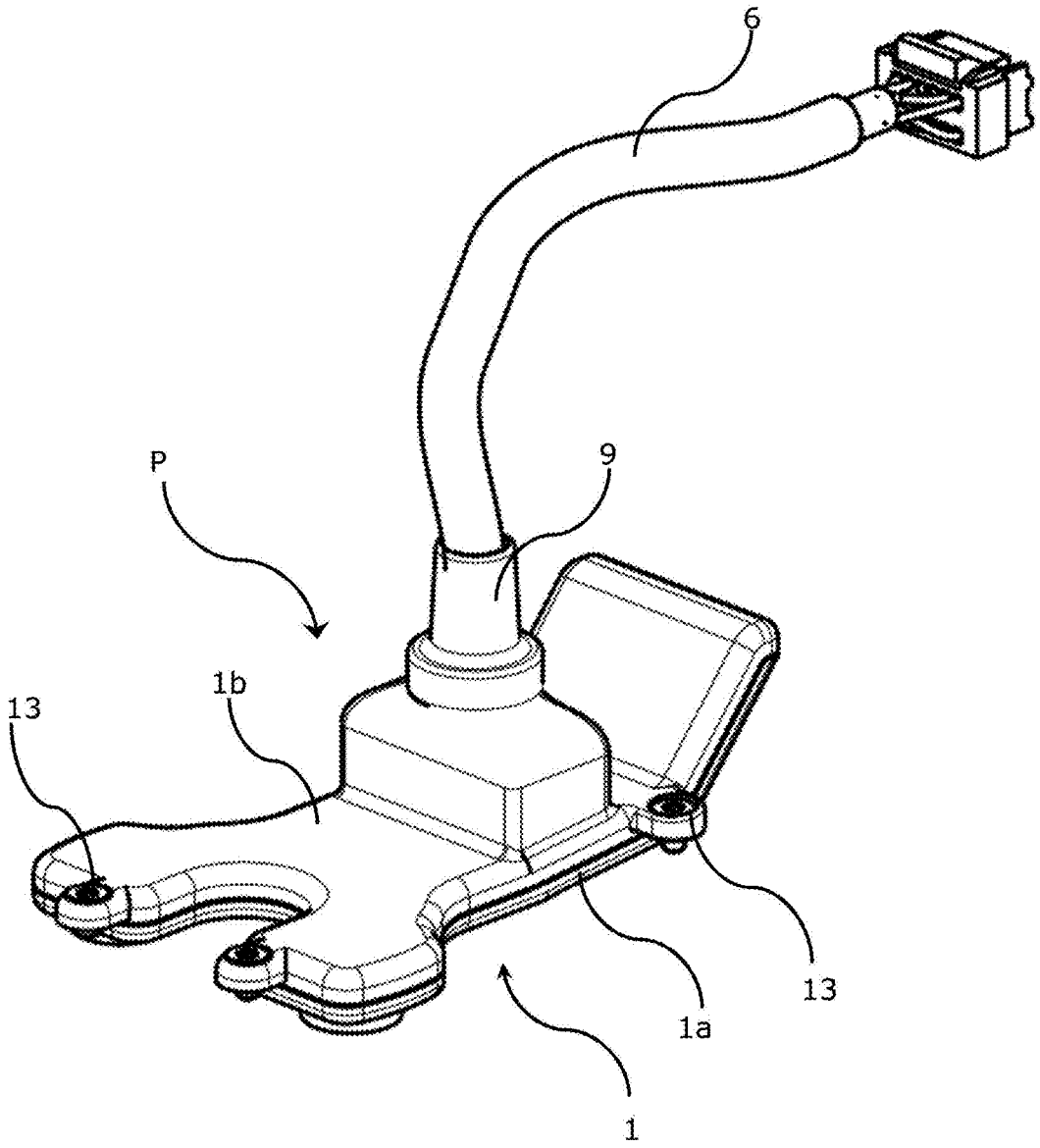
FIG. 2 is a perspective view of the independent optical unit, before assembly in the cup-shaped shell containing the ELM group.
Figure 3:
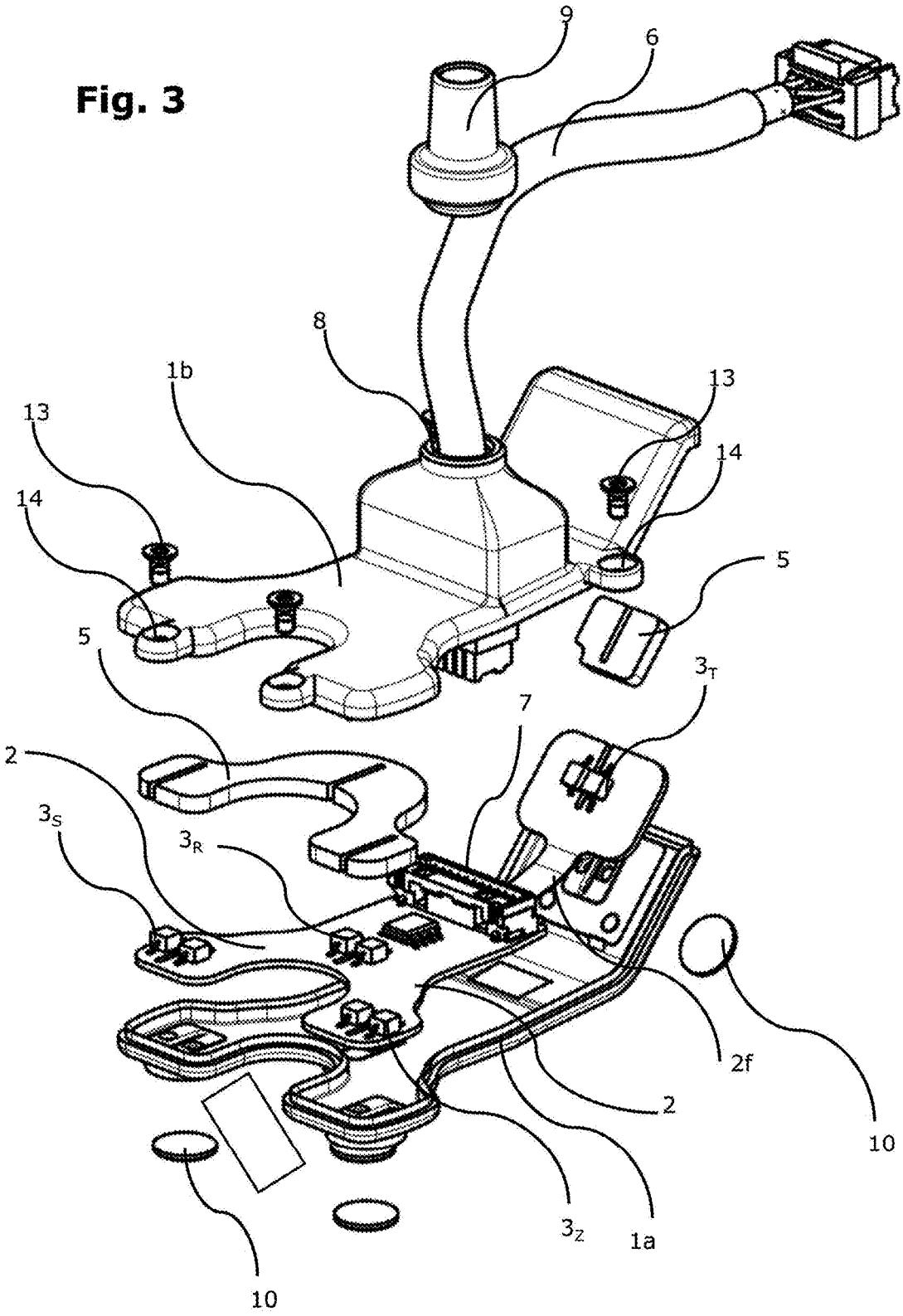
FIG. 3 is an exploded view of the optical unit of FIG. 2.
Figure 4:
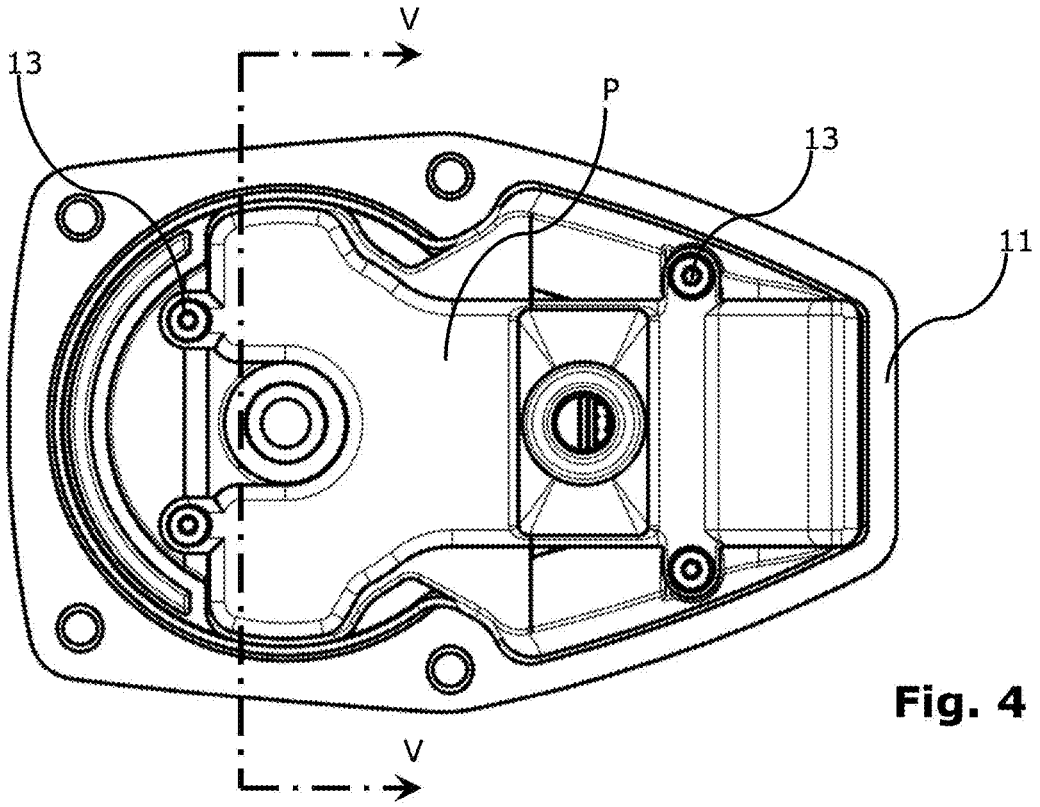
FIG. 4 is a plan view of the optical unit of FIG. 2, when assembled and fixed into the cup-shaped shell enclosing the ELM group.
Figure 5:
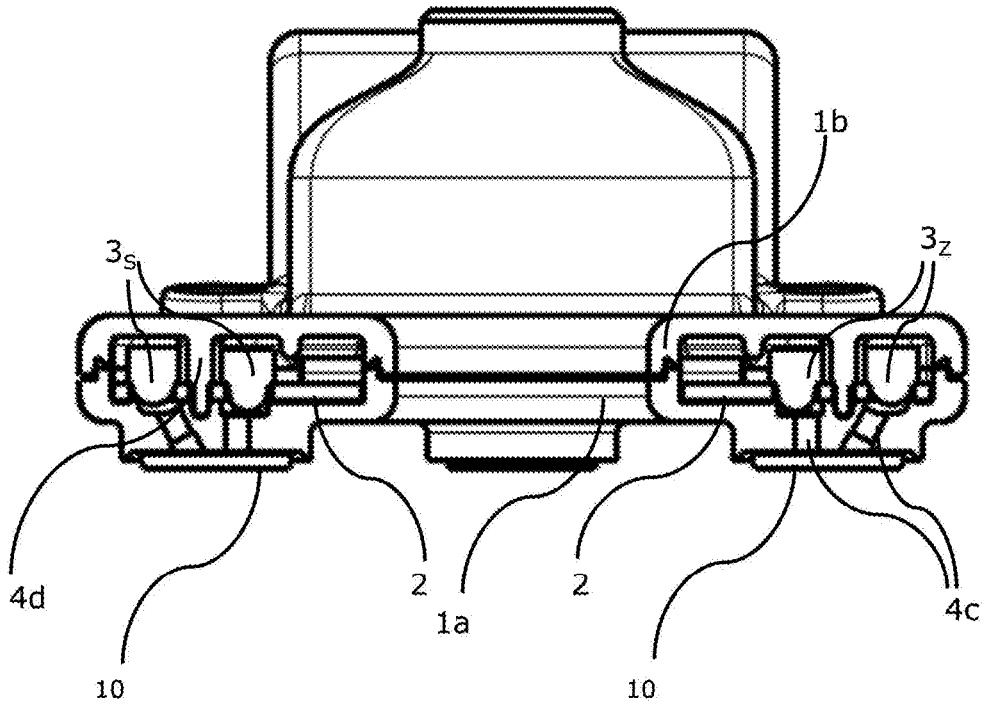
FIG. 5 is a cross-sectional view of the optical unit of FIG. 2, taken along the line V-V of FIG. 4.

The innovative construction of the optical unit P of the present invention is clearly visible in FIG. 2 and it is illustrated in greater detail in the exploded view of FIG. 3 and sectional views of FIGS. 4 and 5. Hence, the optical unit P includes a protection box 1 delimiting its external size and comprising of a lower half-box 1*a* and an upper half-box 1*b* mutually joined by means of a suitable coupling and closing system which ensures a complete dust-and liquid-tight sealing. The protection box 1 is manufactured by moulding plastic material and contains within all the elements contributing to the operation of the optical unit P. Inside the half-box 1*a* a rigid-flex PCB 2 is housed, onto which four pairs of emitting-receiving optical elements 3 are soldered (marked in the drawings with the reference number 3 accompanied by a letter index corresponding to the type of sensor: T, S, Z, R). Diaphragms 4*d* and optical channels 4*c* serving said optical elements 3 and being necessary for the selection and shielding of the light beams are illustrated in greater detail in FIG. 5, and are formed by moulding, preferably in the same moulding operation as the protection box 1 of which they are therefore an integral part. Each optical sensor of the optical unit P of the present invention, regardless of the control type T, S, Z or R it is intended for, comprises therefore of a pair of emitting-receiving optical elements 3, of respective optical channels 4*c* and diaphragms 4*d*, and of darkening elements 5 of foam material which prevent the diffusion of light radiation in undesirable directions. The specific construction and the further details of operation of said optical sensors—characterised by optical elements 3 of the SMD type mounted with their optical axes parallel to each other and perpendicular to the PCB surface 2—are extensively disclosed in the previously mentioned EP-3620561, in the name of the same Applicant, the content of which is herein fully referred to for the sole purpose of understanding the correct operation of said optical sensors, said operation not forming part, however, of the present invention.

The use of a rigid-flex PCB 2-i.e. a PCB consisting of more than one flat and rigid portion of the traditional type, mechanically and elastically connected by portions which are, on the contrary, highly flexible-allows to easily manage the different inclination between the optical sensors of the type S, Z and R, all arranged in a single horizontal plane, and the optical sensor of type T which lies instead on a plane strongly inclined with respect to said common horizontal plane of said first group of sensors. The PCB 2 comprises in fact two distinct rigid portions having different angular orientation, on each of which optical elements 3 of respective optical sensors are soldered, said rigid portions being connected by a flexible portion 2f which contains inside the copper traces interconnecting the SMT components mounted on said two rigid portions of PCB 2.

In an advantageous manner compared to what disclosed by the above-mentioned prior patent, in the optical unit P of the present invention the optical channels 4*c* and the diaphragms 4*d* are directly formed by moulding in the protection box 1; the optical channels 4*c* being formed in the lower half-box 1*a* and the diaphragms 4*d* in the upper half-box 1*b*, respectively, thus significantly simplifying both the manufacturing and the assembly of this device. In the same half-box 1*a*, in fact, a precise housing seat for the PCB 2 is preformed, said housing seat comprising of a plurality of elements which cooperate in maintaining the PCB 2 in a predetermined position, so that the PCB 2 insertion into the half-box 1*a* can be carried out quickly and with the maximum precision of mutual positioning of the optical elements 3 with respect to the optical channels 4*c* and diaphragms 4*d*.

Figure 6:
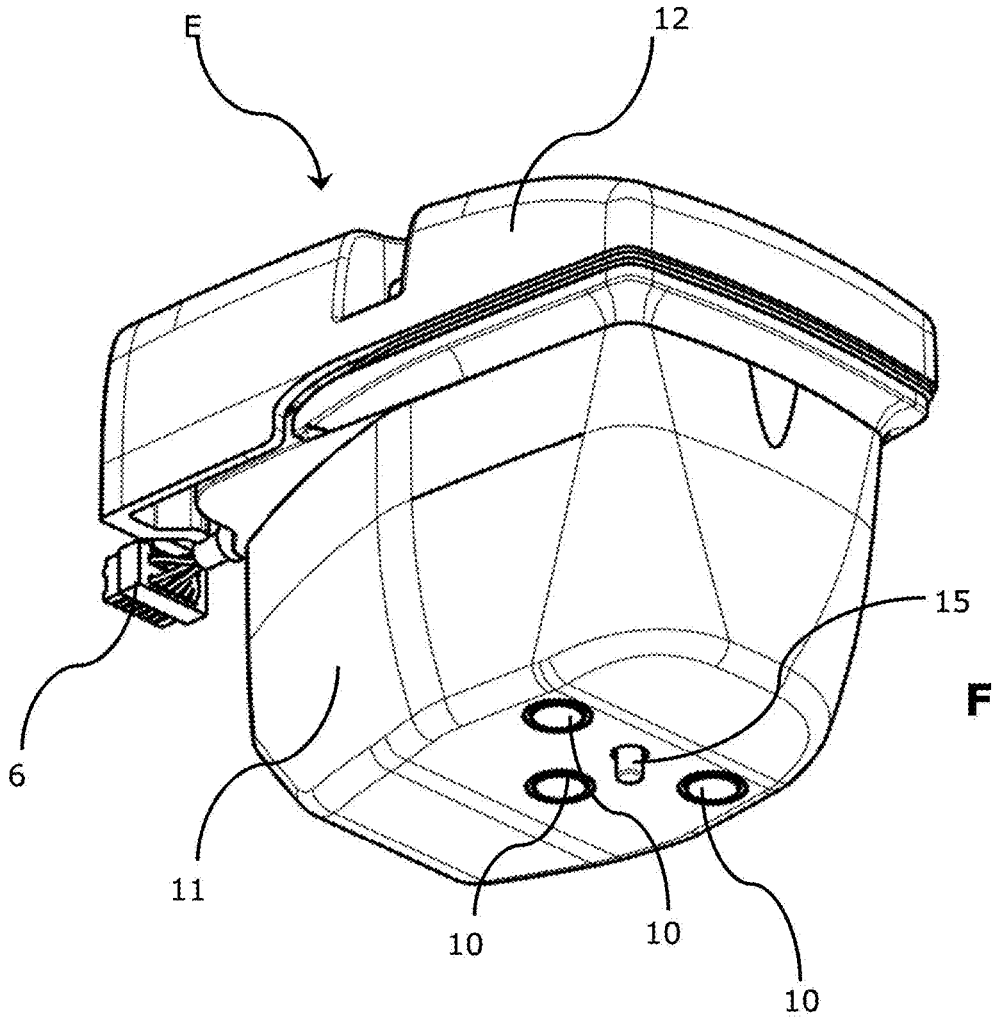
FIG. 6 is a bottom perspective view of the cup-shaped shell enclosing the ELM group and the optical unit illustrated in FIGS. 2-5.

Upon said positioning of the PCB 2 has taken place, darkening elements 5 preferably made of foam material are placed on each pair of optical elements 3. The darkening elements 5 are necessary to prevent an undesirable direct passage of light between the two emitting-receiving optical elements 3 of the same optical sensor, which would compromise the correct operation of said optical sensor. Finally, the PCB 2 is electrically connected to the weft feeder processing board (not illustrated), which controls the logical functions of the weft feeder, by means of a suitable wiring; for example a wiring cable 6 provided with two male terminal connectors, respectively connected on one side to a corresponding female connector 7 integral with the PCB 2, wherein the entire network of the PCB 2 copper traces converges, and on the other side to a special female connector formed in said weft feeder processing board. The wiring cable 6 comes out of the upper half-box 1*b* through a hole 8 formed in the same, said hole 8 being then closed by a usual rubber gasket 9 which elastically adheres both to the edge of the hole 8 and to the lateral surface of the wiring cable 6, thus ensuring an excellent level of sealing of the optical unit P against dust and liquids entering into the protection box 1. Holes formed in the lower half-box 1*a*, for the passage of the light radiation exchanged by the optical elements 3, are closed and sealed in a manner well known per se by transparent glass discs 10 (FIGS. 5 and 6).

After having thus completed the positioning of the various components on the lower half-box 1*a*, the wiring cable 6 is connected onto the same and the upper half-box 1*b* is concurrently mounted and sealed, by means of an appropriate coupling and closing system which ensures dust-and liquid-tight sealing, thus forming the optical unit P of the invention. At this point, the protection box 1 is installed inside the metal cup-shaped shell 11, which also houses the electromagnet group E, and fixed to the cup-shaped shell itself by means of removable fixing means 13 (for example screws or press studs) housed in through holes 14 provided in the upper half-box 1*b*. In a manner known per se, the cup-shaped shell 11 can indifferently comprise of a single or multiple elements and is closed at the top by a lid 12 equipped with a sealing gasket. To facilitate and speed up the assembly of the protection box 1 inside the cup-shaped shell 11, its external features of shape and size are designed in such a way as to allow a custom-fit assembly inside the cup-shaped shell 11, while the glass discs 10 partially protruding from the bottom of the lower half-box 1*a*, as illustrated in FIG. 5, are positioned into respective holes formed in the cup-shaped shell 11 (FIG. 6).

From the preceding description it is evident how the weft feeder of the present invention has fully achieved the intended objects. The optical unit P described above is in fact completely independent, both mechanically and electrically, from the metal cup-shaped shell 11 within which it is housed, and from the electromagnet group E, and it is therefore possible to quickly remove the optical unit P in its entirety—for any repair or maintenance needs—by simply loosening the removable fixing means 13 and detaching the wiring cable 6 from the weft feeder processing board, upon removal of any cable glands arranged along the wiring cable 6 path. Furthermore, the positioning and wiring of the individual optical sensors 3 are completely independent one the other and therefore, depending on the target weft feeder and the intended use thereof, the optical unit P can be provided with the desired number and type of optical sensors 3, without this requiring any change to the design.

However, it is understood that the invention should not be considered as limited to the specific arrangements illustrated above, which are only exemplary embodiments thereof, but that different variants are possible, all within the reach of a person of ordinary skill in the art, without thereby departing from the scope of protection of the invention, which is only defined by the following claims.

LIST OF REFERENCES

A—hollow shaft
C—base body
D—drum
E—electromagnet group (or ELM group)
P—optical unit
R—reserve verification optical sensor
S—exit optical sensor, direction S
T—entry optical sensor
W—winding group
Z—exit optical sensor, direction Z
1—protection box
1*a*—lower half-box
1*b*—upper half-box
2—rigid-flex PCB
2*f*—flexible portion of PCB 2
3—optical elements
4*c*—optical channels
4*d*—diaphragms
5—darkening elements
6—wiring cable
7—female connector
8—housing hole of cable 6
9—rubber gasket
10—glass
11—cup-shaped shell
12—lid of the cup-shaped shell 11
13—removable fixing means
14—holes for fixing means 13
15—stop pin of the weft thread

The invention claimed is:

1. A weft feeder for weaving looms including a winding group (W) to wind a weft thread on a weft feeder drum (D), an optical unit (P) provided with one or more optical sensors (T, R, S, Z) to monitor the weft thread winding on the drum (D) and the weft thread release from said drum, an electromagnet group (E) to control the movement of a stop pin (15) which prevents the weft thread from being released from said drum (D), said electromagnet group (E) being enclosed within a cup-shaped shell (11) from which said stop pin (15) protrudes to interfere with said drum (D), and a weft feeder processing board which controls the logical functions of the weft feeder, wherein said optical unit (P) is enclosed inside a closed and sealed protection box (1), wherein said optical unit (P) includes a printed circuit board (2) with said one or more optical sensors (T, R, S, Z) and said optical unit (P) is electrically connected to said weft feeder processing board by a direct wiring comprising a wiring cable (6) electrically connected to said printed circuit board (2) and to said weft feeder processing board via plug connections and wherein said protection box (1) is housed and removably fixed inside said cup-shaped shell (11).

2. The weft feeder for the weaving looms according to claim 1, wherein functions of said optical unit (P) are independent and autonomous with respect to functions of the electromagnet group (E) enclosed within the same cup-shaped shell (11).

3. The weft feeder for the weaving looms according to claim 1, wherein said protection box (1) includes a lower half-box (1*a*) and an upper half-box (1*b*) which are mutually joined.

4. The weft feeder for the weaving looms according to claim 3, wherein said protection box (1) is dust-and liquid-tight sealed.

5. The weft feeder for the weaving looms according to claim 3, further including optical channels (4*c*) and diaphragms (4*d*) of said optical sensors (T, R, S, Z), which are integrally formed with said protection box (1).

6. The weft feeder for the weaving looms according to claim 5, wherein said optical channels (4*c*) and diaphragms (4*d*) are respectively formed in said lower half-box (1*a*) and in said upper half-box (1*b*).

7. The weft feeder for the weaving looms according to claim 1, wherein said printed circuit board (2) comprises soldered emitting and receiving optical elements (3) of said one or more optical sensors (T, R, S, Z).

8. The weft feeder for the weaving looms according to claim 7, wherein said printed circuit board (2) is a rigid-flex printed circuit board including two rigid portions with said soldered optical elements (3).

9. The weft feeder for the weaving looms according to claim 8, wherein said two rigid portions of the printed circuit board (2) have different inclinations and are connected by a flexible portion (2*f*) of said printed circuit board (2), which contains inside copper traces interconnecting the optical elements (3) mounted on said two rigid portions.

10. The weft feeder for the weaving looms according to claim 7, wherein darkening elements (5) of foam material are further provided, arranged on said optical elements (3).

11. The weft feeder for the weaving looms according to claim 1, further including a rubber gasket (9) sealing an exit hole (8) of the wiring cable (6) coming out of said protection box (1).

* * * * *